United States Patent [19]

Hutchinson

[11] Patent Number: 4,467,830

[45] Date of Patent: Aug. 28, 1984

[54] CONDUIT FOR APPARATUS DISCHARGING A LIQUID

[75] Inventor: John W. Hutchinson, Fairview, Pa.

[73] Assignee: American Sterilizer Company, Erie, Pa.

[21] Appl. No.: 257,779

[22] Filed: Apr. 27, 1981

[51] Int. Cl.[3] ..... F16K 24/00

[52] U.S. Cl. ..... 137/590; 137/216; 4/427

[58] Field of Search ..... 4/427, 423; 137/216, 137/207, 590

[56] References Cited

U.S. PATENT DOCUMENTS

| | | | |
|---|---|---|---|
| 2,056,357 | 10/1936 | Luff | 137/216 |
| 2,405,639 | 8/1946 | Boosey | 137/216 |
| 3,086,543 | 4/1963 | McAuley | 137/216 |
| 3,158,169 | 11/1964 | Smith | 137/216 |

FOREIGN PATENT DOCUMENTS

| | | | |
|---|---|---|---|
| 1609052 | 3/1970 | Fed. Rep. of Germany | 137/216 |

*Primary Examiner*—A. Michael Chambers

*Attorney, Agent, or Firm*—Robert D. Yeager; Andrew J. Cornelius

[57] ABSTRACT

A conduit accepts liquid discharged from apparatus into which liquid is supplied and directs the discharged liquid to the discharge side of a plumbing system. The conduit includes a pair of backup outlets that prevent discharged liquid from reentering the apparatus when liquid flow through the discharge side of the plumbing system becomes blocked by diverting the backed up liquid from the discharge of the apparatus when the backed up liquid reaches a predetermined level. The conduit prevents splashing discharged liquid from leaving the conduit through the backup outlets.

3 Claims, 5 Drawing Figures

CONDUIT FOR APPARATUS DISCHARGING A LIQUID

BACKGROUND OF THE INVENTION

1. Field of the Invention

The present invention relates generally to conduits and, in particular, to a conduit for preventing discharged liquid from contaminating the water supply of a plumbing system when the discharge side of the plumbing system becomes blocked.

2. Description of the Prior Art

A plumbing system, or the outlet of apparatus in liquid communication with the supply and discharge of the plumbing system, can become blocked during use. If a portion of the discharge side of a plumbing system becomes blocked, liquid discharged by apparatus into the blocked portion can back up into the discharging apparatus and contaminate the water supply of the plumbing system. Accordingly, such a situation must be avoided if the integrity of the water supply system of a building or a geographical area is to be maintained.

Workers in the field have devised a variety of ways of preventing liquid discharged from apparatus in liquid communication with a plumbing system from reentering the apparatus and contaminating the water supply of the system when the discharge side of the plumbing through which the discharged liquid is intended to flow becomes blocked. In the case of sterilizers, a bracket is mounted to the discharge pipe of the sterilizer and a funnel with an open top is mounted to the bracket beneath it. Accordingly, when the outlet of the funnel or the discharge side of the plumbing system into which the funnel normally directs discharged liquid becomes blocked, water backs up in the funnel and flows over the top edge of the funnel rather than reentering the sterilizer. The major disadvantage associated with the use of such a funnel is the splashing that occurs when neither the funnel nor the discharge side of the plumbing system is blocked and the sterilizer is discharging liquid into the funnel. Some of the discharged liquid splashes as it strikes the interior of the funnel, leaves the funnel through its open top and collects on the floor in the vicinity of the sterilizer, causing safety problems and, possibly, damaging material with which it comes into contact.

Therefore, a need exists for a conduit which passes discharged liquid to the discharge side of a plumbing system, that prevents the discharged liquid from reentering the apparatus which discharged it when either the conduit or the discharge side of the plumbing system becomes blocked, and which prevents the discharged liquid from splashing out of the conduit unless such a blockage occurs.

SUMMARY OF THE INVENTION

The present invention provides a device for accepting liquid discharged from apparatus into which liquid is supplied and directing the discharged liquid into the discharge side of a system. The device prevents the discharged liquid from reentering the apparatus when the flow of liquid through the discharge side of the system stops. The present invention includes a conduit having an inlet in liquid communication with the discharge of the apparatus that receives the discharged liquid from the discharge, a main outlet in liquid communication with the discharge side of the system that introduces the discharged liquid into the discharge side of the system, and at least two backup outlets which divert the discharged liquid from the discharge of the apparatus when the discharged liquid occupies a predetermined volume within the conduit. Each backup outlet defines an overflow rim over which the liquid discharge flows through the backup outlet when the liquid discharge occupies the predetermined volume. The overflow rim and the outlet define an air gap therebetween that prevents the discharge from coming into contact with the inlet before the discharge flows through the backup outlet over the overflow rim. Further, the present invention includes apparatus for preventing the discharged liquid from traveling through the backup outlet unless the discharged liquid occupies a predetermined volume within the conduit.

Preferably, each backup outlet is an opening defined by the conduit and a member is disposed between the path of travel of the discharged liquid through the conduit and the opening to block from the opening discharged liquid deflected toward the opening from its normal path.

Accordingly, the present invention is useful for preventing discharged liquid from backing up into the apparatus discharging the liquid when the discharge side of the system with which the apparatus is in liquid communication is blocked, yet prevents water from splashing out of the conduit when the discharge side of the system is unblocked and discharged liquid is flowing through the conduit and the discharge side of the system.

BRIEF DESCRIPTION OF THE DRAWINGS

The following detailed description of the preferred embodiments can be understood better if reference is made to the accompanying drawings in which.

DETAILED DESCRIPTION OF THE PREFERRED EMBODIMENTS

Figure 1:
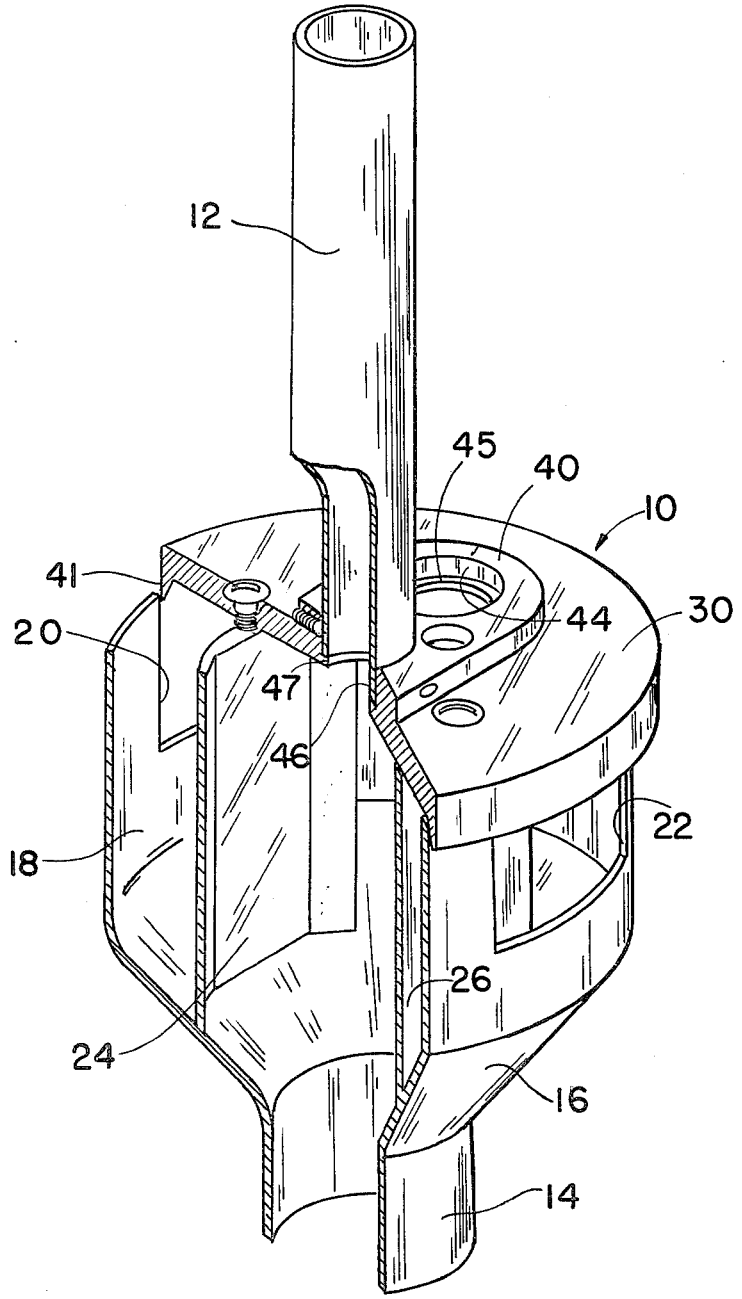
FIG. 1 is an isometric view showing a conduit constructed according to the provisions of the present invention secured to the discharge pipe of a sterilizer.
Figure 2:
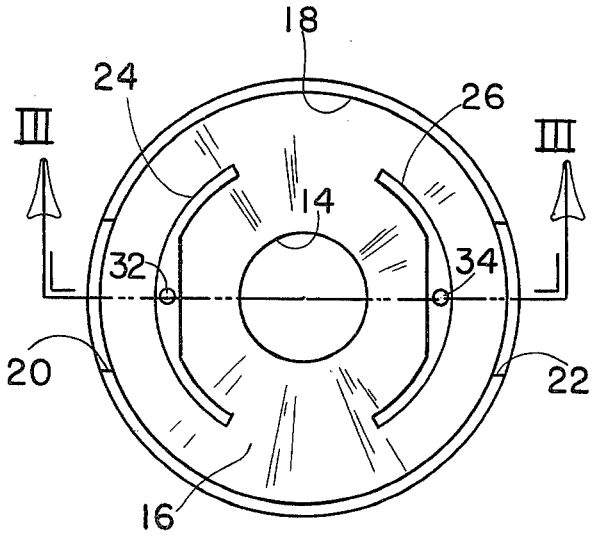
FIG. 2 is a top plan view of the conduit, without the cover plate, shown in FIG. 1.

The preferred embodiment of the present invention described below is used to receive liquid discharged by a sterilizer and to direct the discharged liquid into the discharge side of a plumbing system, as shown in FIG. 1.

FIG. 1 shows the preferred embodiment of the present invention, conduit 10, secured to the discharge pipe 12 of a sterilizer (not shown). Conduit 10 can be formed from any suitable material, such as glass-filled nylon. Conduit 10 receives liquid discharged from the sterilizer through discharge pipe 12 and directs the discharged liquid to the inlet of the discharge side of a plumbing system (not shown). As can be seen in FIGS. 1 through 4, conduit 10 includes an outlet portion 14 which is in liquid communication with the inlet of the discharge side of the plumbing system to pass discharged liquid to it. Conduit 10 also includes a sloped portion 16 which directs liquid discharged through discharge pipe 12 toward outlet 14. Also, sloped portion 16 accumulates discharged liquid during periods when conduit 10 is not able to pass discharged liquid to the plumbing system as fast as discharge pipe 12 introduces discharged liquid into conduit 10. Cylindrical portion 18 of conduit 10 facilitates mounting of conduit 10 to the sterilizer or the discharge pipe 12 and aids in retaining within conduit 10 discharged liquid that is deflected from its normal path of travel through conduit 10.

Cylindrical portion 18 defines a pair of openings 20 and 22 which prevent discharged liquid accumulating in conduit 10 from reentering or backing up into the sterilizer through discharge pipe 12 and contaminating the water supply of the plumbing system. Outlets 20 and 22 define overflow rims 212 and 210, respectively. When either outlet 14 or the discharge side of the plumbing system becomes blocked and the flow of discharged liquid through the discharge side of the plumbing system is stopped, discharged liquid begins to accumulate within conduit 10. When the level of the accumulated liquid reaches overflow rims 212 and 210 of openings 20 and 22, respectively, it begins to flow through openings 20 and 22 to the exterior of conduit 10, rather than into the sterilizer.

Figure 3:
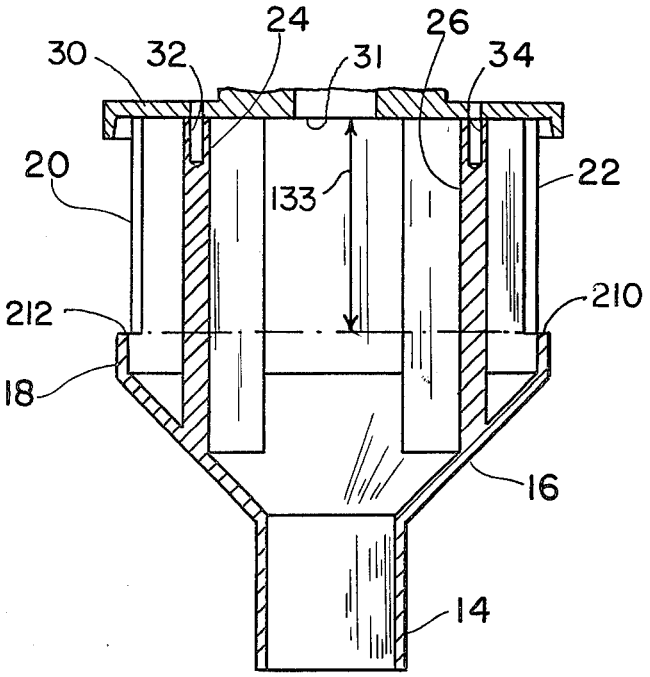
FIG. 3 is a sectional view of the conduit shown in FIG. 2 taken along the line III—III.
Figure 4:
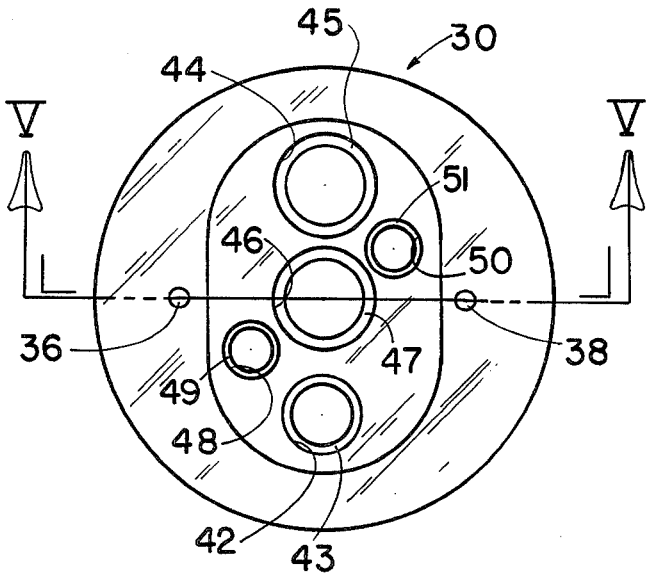
FIG. 4 is top plan view of the cover plate of the conduit shown in FIG. 1.
Figure 5:
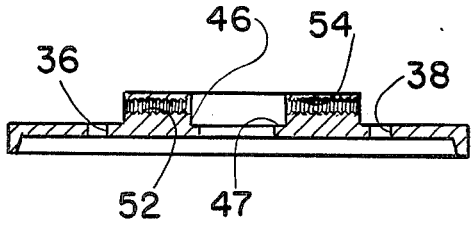
FIG. 5 is a sectional view of the cover plate shown in FIG. 4 taken along the line V—V.

Conduit 10 defines an air gap, which is defined as a vertical space between the bottom surface 31 of cover 30 where liquid enters conduit 10 and overflow rims 210 and 212. The air gap is indicated in FIG. 3 as vertical space 133. Air gap 133 ensures that waste will not come into contact with and be suctioned into the supply side of the plumbing system when the discharge side of the system becomes blocked.

Conduit 10 includes a pair of baffles 24 and 26 secured to sloped portion 16—or formed integral therewith—between the normal path of flow of discharged liquid through conduit 10 and openings 20 and 22. Baffles 24 and 26 partially surround the top portion 28 of outlet 14 and extend from sloped portion 16 to the top of conduit 10 to prevent discharged liquid deflected from its normal path of travel through conduit 10 from passing through openings 20 and 22. However, discharged liquid accumulating in conduit 10 due to a blockage in the plumbing system can flow around baffles 24 and 26 to cylindrical portion 18 and, when the accumulated liquid rises to a sufficient level, can leave conduit 10 through openings 20 and 22.

Conduit 10 includes a cover plate 30 which is mounted to the top of conduit 10. Cover 30 facilitates mounting conduit 10 to discharge pipe 12 and prevents discharged liquid from leaving conduit 10 through its top. Baffles 24 and 26 include tapped holes 32 and 34 into which threaded screws can be secured through openings 36 and 38 of cover plate 30 to secure cover plate 30 to baffles 24 and 26 and cylindrical portion 18. Cover plate includes a downward extending flange 41 that overlaps the top edge of conduit 10 when it is secured in place. Also, cover plate 30 includes a raised portion 40 into which a discharge pipe 12 can be inserted to ensure that liquid discharged from pipe 12 flows into conduit 10. Raised portion 40 includes openings 42, 44, 46, 48 and 50 into one of which a discharge pipe 12 can be secured. Openings 42, 44, 46, 48 and 50 include shoulders 43, 45, 47, 49 and 51, respectively. Shoulders 43, 45, 47, 49 and 51 prevent insertion of a properly dimensioned discharge pipe 12 completely through an opening 42, 44, 46, 48 or 50 and into conduit 10 to an extent that would permit water backing up in the discharge side of the plumbing system to reenter pipe 12 and the water supply of the plumbing system. The choice of which opening to use is dictated by the size of the discharge pipe 12 used. Alternatively, discharge pipes can be inserted into several openings of raised portion 40 to provide controlled discharge for more than one discharge pipe. Unused openings can be plugged with appropriate plastic inserts. A discharge pipe 12 can be secured in central opening 46 by threading a pair of set screws through tapped holes 52 and 54 until they bear against discharge pipe 12.

Outlet 14 of conduit 10 can be placed in liquid communication with the inlet of the discharge side of the plumbing system in any known manner.

The determination of the relative diameters of discharge pipe 12, openings 20 and 22, cylindrical portion 18 and outlet 14 can be made easily by a person having ordinary skill in the art. However, a conduit with openings 20 and 22 having a combined discharge area of 9.376 square inches and a discharge area through outlet 14 of two inches can accommodate a flow from a discharge pipe 12 of 339.9 gallons per minute. If the discharge area through outlet 14 is reduced to one and one-half inches, the flow rate which conduit 10 can accommodate decreases to 162.9 gallons per minute. Presently, the maximum flow rate through the discharge pipe of a sterilizer is fifteen gallons per minute. The results of tests conducted by applicant on conduits having the dimensions described above indicate that the level of the discharged liquid within conduit 10 rises to a height of one half inch above the bottom of openings 20 and 22 when outlet 14 of conduit 10 is blocked.

What is claimed is:

1. A device for accepting liquid discharged from apparatus and directing the discharged liquid into the discharge side of a system that conveys the discharged liquid, and for preventing the discharged liquid from reentering the apparatus comprising:

a conduit defining an inlet through which the liquid discharge flows into said conduit, a main outlet through which the liquid discharge flows from said conduit into the discharge side of the system, said liquid discharge traveling along a normal path of flow from said inlet to said main outlet, and at least two backup outlets which provide fluid communication between the interior of said conduit and the exterior of said conduit through which at least a portion of the liquid discharge flows from the conduit when a predetermined volume of liquid discharge backs up in said conduit;

each said backup outlet defines an overflow rim over which said discharge flows through said backup outlet when said discharge occupies said predetermined volume;

said overflow rims and said inlet defining an air gap therebetween that prevents said discharge from coming into contact with said inlet before said discharge flows through said backup outlets over said overflow rims; and a blocking member disposed within said conduit between (i) said normal path of flow of the discharged liquid through said conduit and (ii) each said backup outlet, to prevent liquid discharge deflected from said normal path of flow from passing through said backup outlets, unless the liquid discharge occupies said predetermined volume, said blocking member defining at least two openings through which liquid backing up within said conduit can flow to said backup outlets.

2. The conduit recited by claim 1 wherein each said opening provides a path of flow for said backed up liquid to both said backup outlets.

3. The device recited by claim 1 wherein said conduit includes a portion having the shape of a funnel.

* * * * *

UNITED STATES PATENT AND TRADEMARK OFFICE

CERTIFICATE OF CORRECTION

PATENT NO. : 4,467,830

DATED : August 28, 1984

INVENTOR(S) : John W. Hutchinson

It is certified that error appears in the above—identified patent and that said Letters Patent is hereby corrected as shown below:

Col. 1, line 27, after "plumbing" insert --system--;

Col. 2, line 14, delete "outlet" and substitute therefor --outlets--;

Col. 4, line 45, delete "defines" and substitute therefor --defining--.

Signed and Sealed this

*Sixteenth* Day of *April 1985*

[SEAL]

*Attest:*

DONALD J. QUIGG

*Attesting Officer*

*Acting Commissioner of Patents and Trademarks*